US010371336B2

(12) United States Patent
Lee

(10) Patent No.: US 10,371,336 B2
(45) Date of Patent: Aug. 6, 2019

(54) HEADLAMP APPARATUS

(71) Applicant: HYUNDAI MOBIS CO., LTD., Seoul (KR)

(72) Inventor: Hyun Soo Lee, Seongnam-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 16/027,765

(22) Filed: Jul. 5, 2018

(65) Prior Publication Data

US 2019/0011105 A1 Jan. 10, 2019

(30) Foreign Application Priority Data

Jul. 6, 2017 (KR) ..... 10-2017-0085696

(51) Int. Cl.

| | |
|---|---|
| ***F21S 41/20*** | (2018.01) |
| ***F21S 41/26*** | (2018.01) |
| ***F21S 41/32*** | (2018.01) |
| ***F21S 41/141*** | (2018.01) |
| ***F21S 41/147*** | (2018.01) |
| ***F21S 41/153*** | (2018.01) |
| ***F21S 41/663*** | (2018.01) |
| ***F21Y 115/10*** | (2016.01) |

(52) U.S. Cl.

CPC ..... *F21S 41/285* (2018.01); *F21S 41/141* (2018.01); *F21S 41/147* (2018.01); *F21S 41/153* (2018.01); *F21S 41/26* (2018.01); *F21S 41/32* (2018.01); *F21S 41/323* (2018.01); *F21S 41/663* (2018.01); *F21Y 2115/10* (2016.08)

(58) Field of Classification Search

CPC ..... F21S 41/285; F21S 41/32; F21S 41/141; F21S 41/323; F21S 41/33; F21S 2115/10

See application file for complete search history.

(56) References Cited

U.S. PATENT DOCUMENTS

| | | | | |
|---|---|---|---|---|
| 2006/0285341 | A1* | 12/2006 | Yatsuda | F21S 41/43 362/464 |
| 2009/0257240 | A1* | 10/2009 | Koike | F21S 41/275 362/538 |
| 2010/0149803 | A1* | 6/2010 | Nakano et al. | F21S 43/14 362/235 |
| 2011/0280029 | A1* | 11/2011 | Yamamoto | F21S 41/147 362/516 |
| 2012/0113665 | A1* | 5/2012 | Matsumoto | F21S 41/338 362/518 |
| 2013/0188378 | A1* | 7/2013 | Yamamoto | F21V 13/04 362/512 |
| 2015/0308650 | A1* | 10/2015 | De Kievit et al. | B60Q 1/2665 362/516 |
| 2017/0276980 | A1* | 9/2017 | Kauschke | F21S 41/135 |

* cited by examiner

*Primary Examiner* — Joseph L Williams
*Assistant Examiner* — Jose M Diaz
(74) *Attorney, Agent, or Firm* — H.C. Park & Associates, PLC

(57) ABSTRACT

A headlamp apparatus may include: a light source configured to emit light; a reflector having a reflecting surface with different curvatures in first and second directions crossing each other, and configured to reflect the light emitted from the light source; and a lens configured to receive the light through the reflector, and change the magnification of the light so as to guide the light to the front.

10 Claims, 6 Drawing Sheets
(2 of 6 Drawing Sheet(s) Filed in Color)

HEADLAMP APPARATUS

CROSS-REFERENCE TO RELATED APPLICATION

This application claims priority from and the benefit of Korean Patent Application No. 10-2017-0085696, filed on Jul. 6, 2017, which is hereby incorporated by reference for all purposes as if set forth herein.

BACKGROUND

Field

Exemplary embodiments relate to a headlamp apparatus, and more particularly, to a headlamp apparatus which is capable of implementing a matrix beam using a reflecting surface and lens with different curvatures.

Discussion of the Background

In general, a headlamp apparatus mounted on a vehicle illuminates the road in front of the vehicle using light generated through a plurality of light sources or a single light source. Typically, a halogen lamp is used as a headlamp which illuminates the road in front of the vehicle, in order to secure a driver's front view. Recently, however, the use of a light emitting diode (hereafter, referred to as LED) having a long lifetime and high luminance efficiency has gradually increased.

A light source module used in the LED headlamp according to the related art includes an LED light source for emitting light and a printed circuit board (PCB) for controlling the supply of a current to the LED source. In case of necessity, the light source module includes a light guide, an inner lens and an outer lens, which irradiate light from the LED light source to the outside while guiding the light.

Recently, a headlamp including a plurality of LED light sources arranged in a matrix shape has been developed. The matrix-type headlamp turns off a part of the plurality of LED sources, in order to prevent a glare problem of a driver coming in the opposite direction.

In the related art, since a reflecting surface for reflecting light of the LED light source has a large height, the exterior size of the product may be increased. Furthermore, the use of the reflecting surface having a stepped portion formed by a plurality of facets may reduce luminance efficiency. Therefore, there is a demand for an apparatus capable of solving the problem.

The above information disclosed in this Background section is only for enhancement of understanding of the background of the invention and, therefore, it may contain information that does not constitute prior art.

SUMMARY

Exemplary embodiments of the present invention provide a headlamp apparatus which can implement a matrix beam using a reflecting surface and lens with different curvatures.

Also, embodiments of the present invention are directed to a headlamp apparatus which can reduce the external size of a product, thereby improving mounting compatibility.

In one embodiment, a headlamp apparatus may include: a light source configured to emit light; a reflector having a reflecting surface with different curvatures in first and second directions crossing each other, and configured to reflect the light emitted from the light source part; and a lens configured to receive the light through the reflector, and change the magnification of the light so as to guide the light to the front.

The light source may include a plurality of LED light sources arranged in a matrix shape, and a turn-on of each of the LED light sources may be separately controlled.

The reflecting surface may form a concavely curved surface toward the light source, and a second curvature radius in the second direction may be larger than a first curvature radius in the first direction.

The first direction may be set to a top-to-bottom direction of the reflecting surface, and the second direction may be set to a side-to-side direction of the reflecting surface.

The lens may include: a first lens facing the reflector; and a second lens connected to the first lens part, and formed in a convex shape so as to have different curvatures in third and fourth directions crossing each other.

The second lens may be integrated with the first lens through a forming process.

The second lens may be installed so as to face the opposite direction of the first lens, and formed in a semi-circle cylindrical shape.

The first lens may form a convexly curved surface or flat surface toward the reflector.

A fourth curvature radius in the fourth direction may be smaller than a third curvature radius in the third direction.

The third direction may be set to a top-to-bottom direction of the second lens, and the fourth direction may be set to a side-to-side direction of the second lens.

It is to be understood that both the foregoing general description and the following detailed description are exemplary and explanatory and are intended to provide further explanation of the invention as claimed.

BRIEF DESCRIPTION OF THE DRAWINGS

The patent or application file contains at least one drawing executed in color. Copies of this patent or patent application publication with color drawings(s) will be provided by the Office upon request and payment of the necessary fee.

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
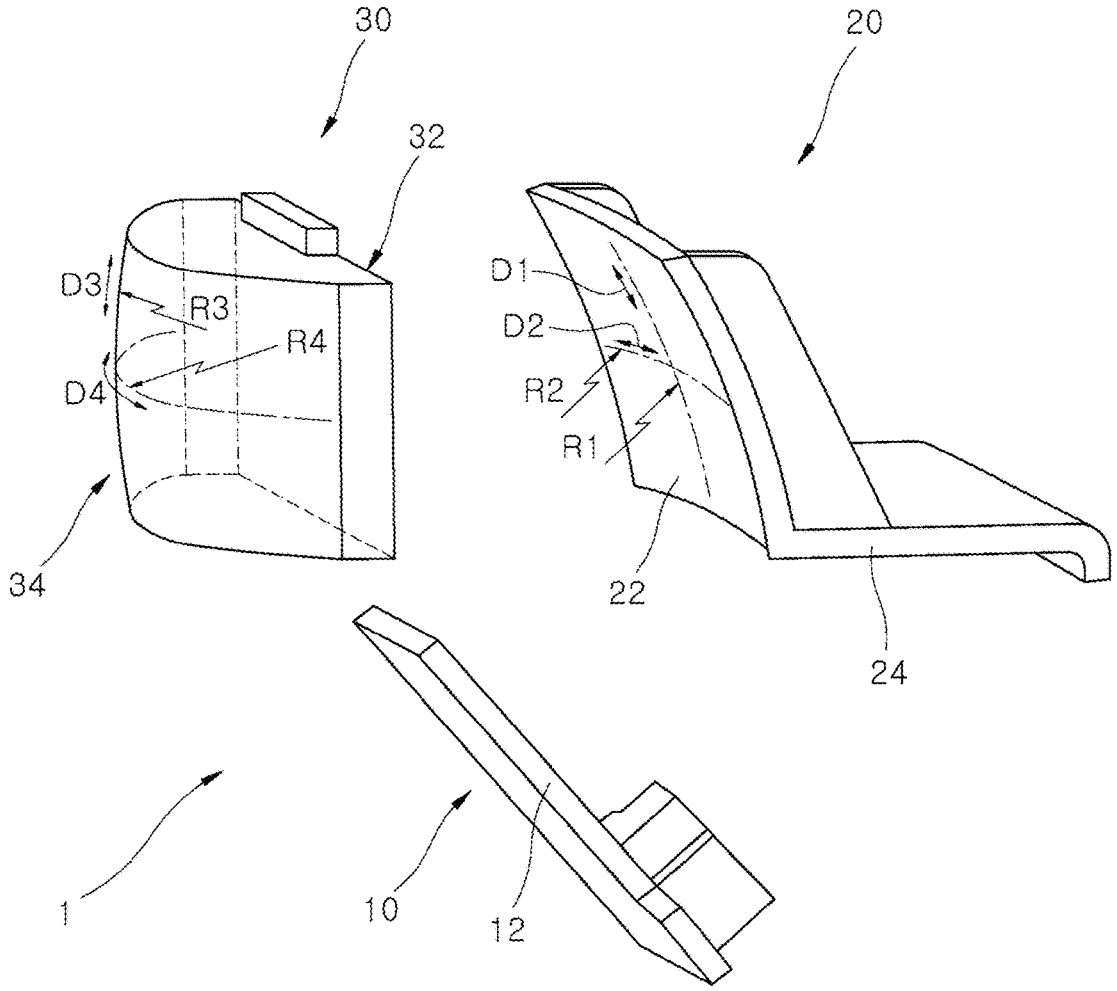
FIG. 1 is a schematic perspective view illustrating main components of a headlamp apparatus in accordance with an embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

It will be understood that for purposes of this disclosure, "at least one of X, Y, and Z" can be construed as X only, Y only, Z only, or any combination of two or more items X, Y, and Z (e.g., XYZ, XYY, YZ, ZZ). Unless particularly described to the contrary, the term "comprise", "configure", "have", or the like, which are described herein, will be understood to imply the inclusion of the stated components, and therefore should be construed as including other components, and not the exclusion of any other elements.

Hereafter, a headlamp apparatus in accordance with an embodiment of the present invention will be described in detail with reference to the accompanying drawings. It should be noted that the drawings are not to precise scale and may be exaggerated in thickness of lines or sizes of components for descriptive convenience and clarity only.

Furthermore, the terms as used herein are defined by taking functions of the invention into account and can be changed according to the custom or intention of users or operators. Therefore, definition of the terms should be made according to the overall disclosures set forth herein.

Figure 2:
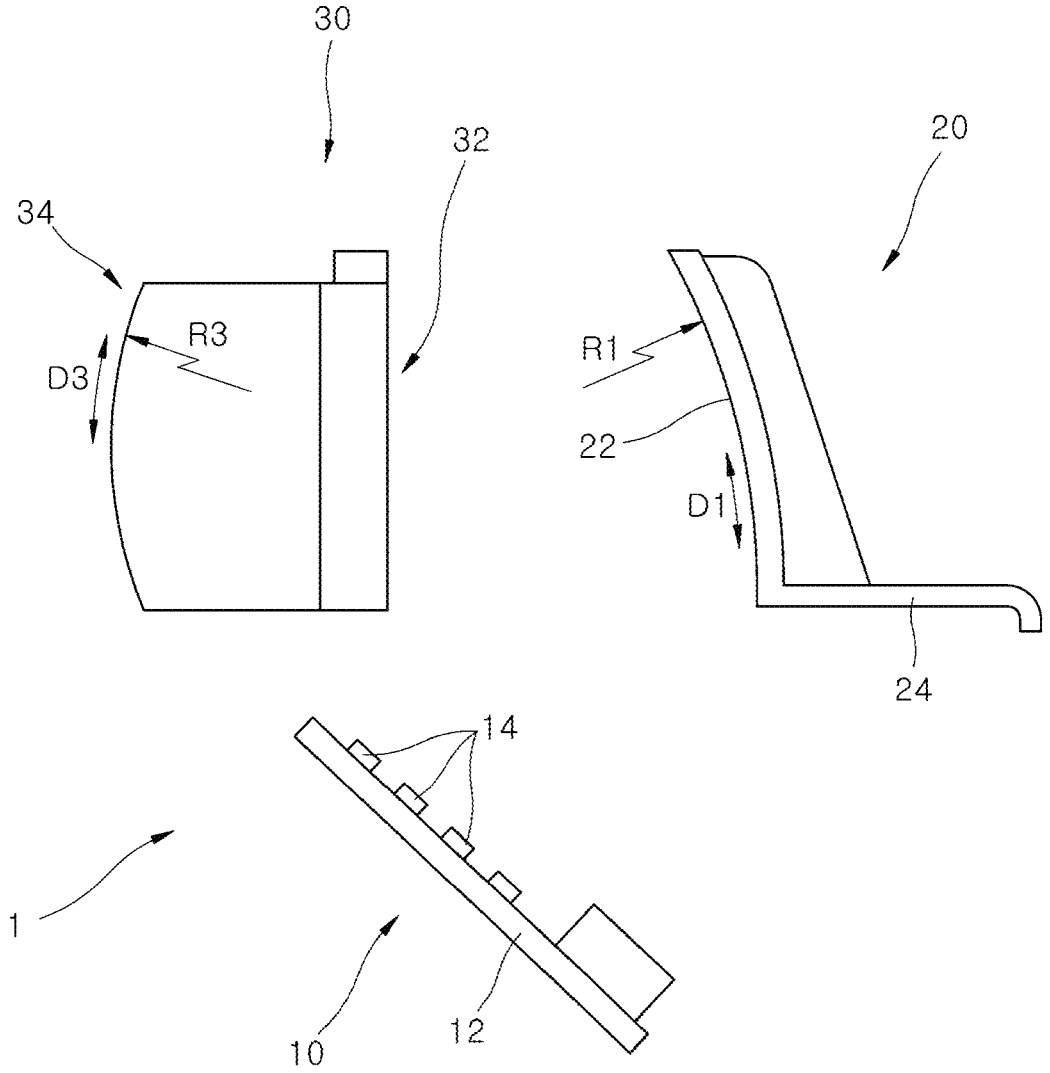
FIG. 2 is a front view illustrating the headlamp apparatus in accordance with the embodiment of the present invention.
Figure 3:
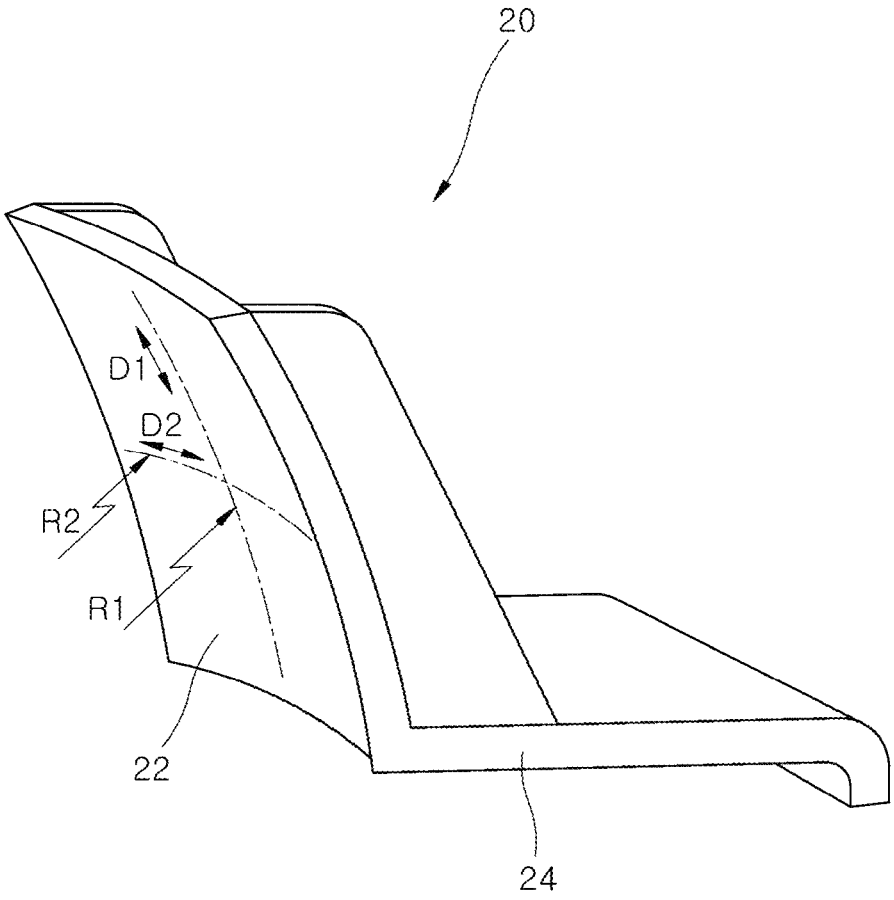
FIG. 3 is a perspective view illustrating a reflector in accordance with the embodiment of the present invention.
Figure 4:
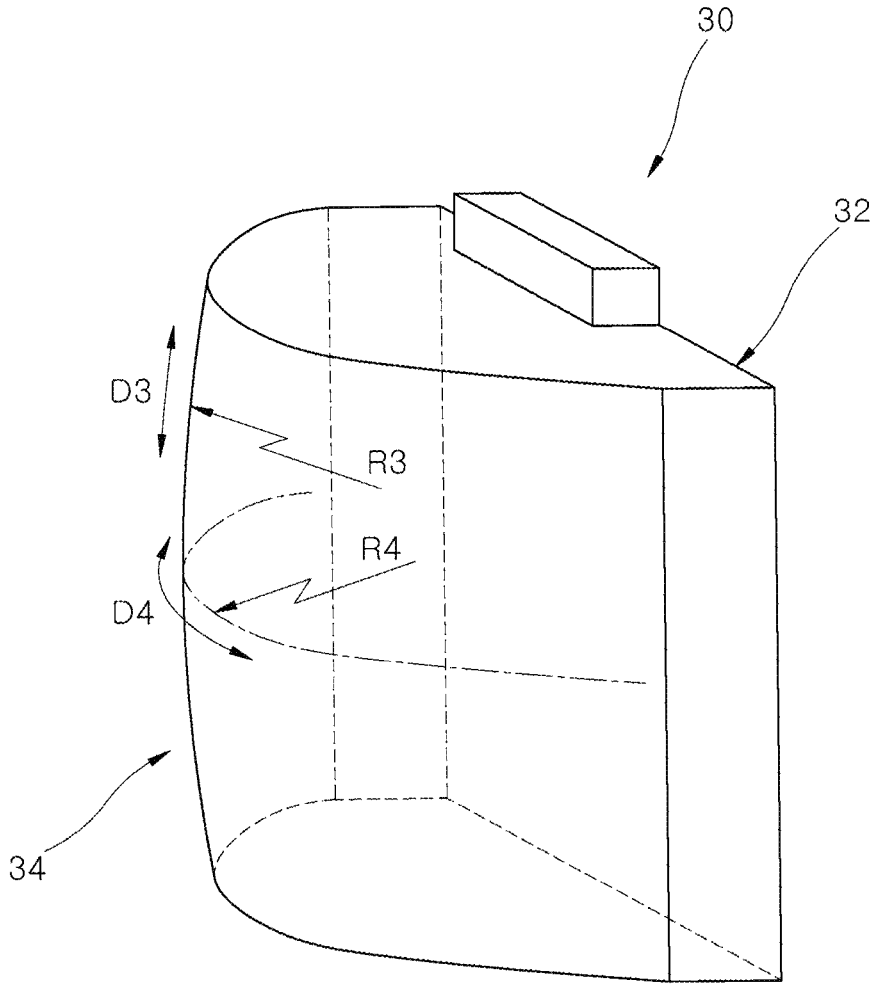
FIG. 4 is a perspective view illustrating a lens in accordance with the embodiment of the present invention.
Figure 5:
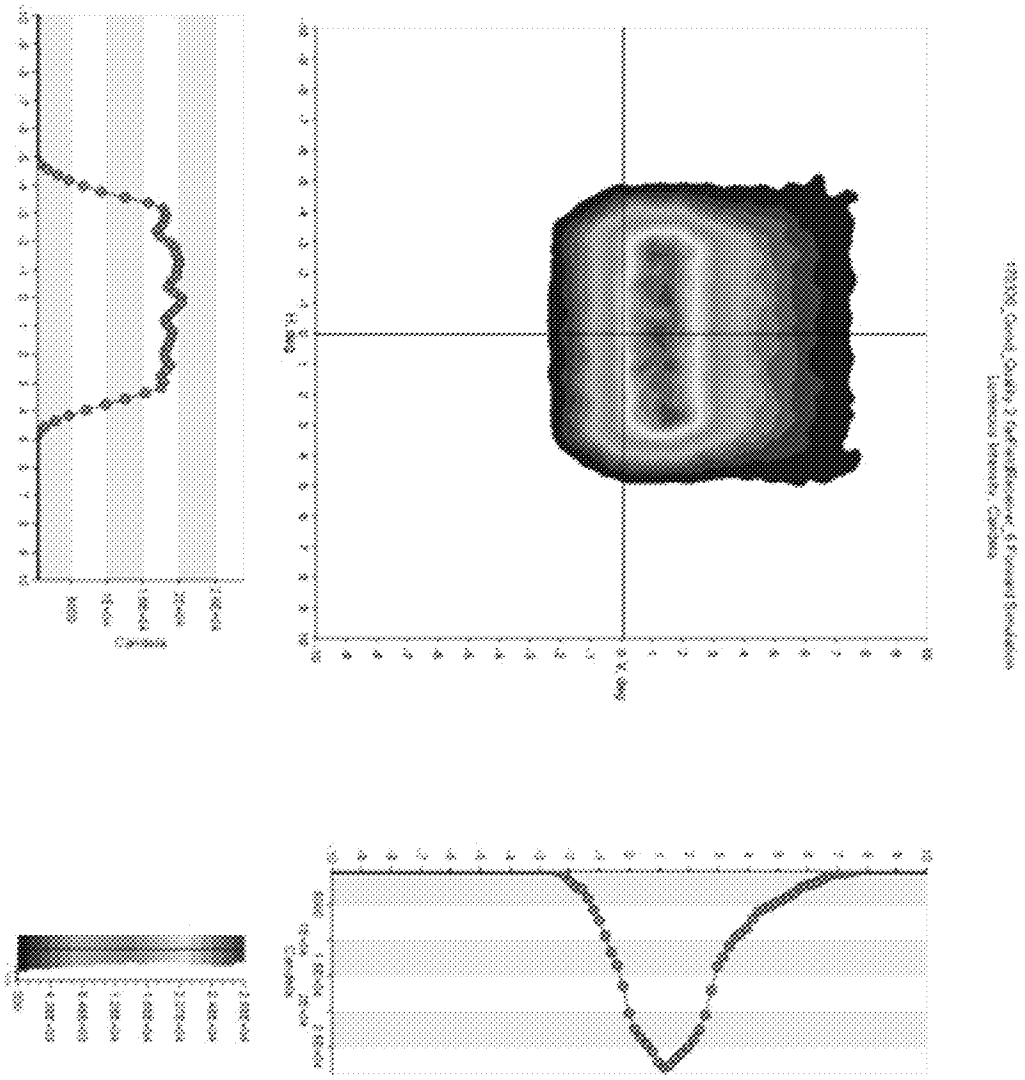
FIG. 5 illustrates an operation state of a light source in accordance with the embodiment of the present invention.
Figure 6:
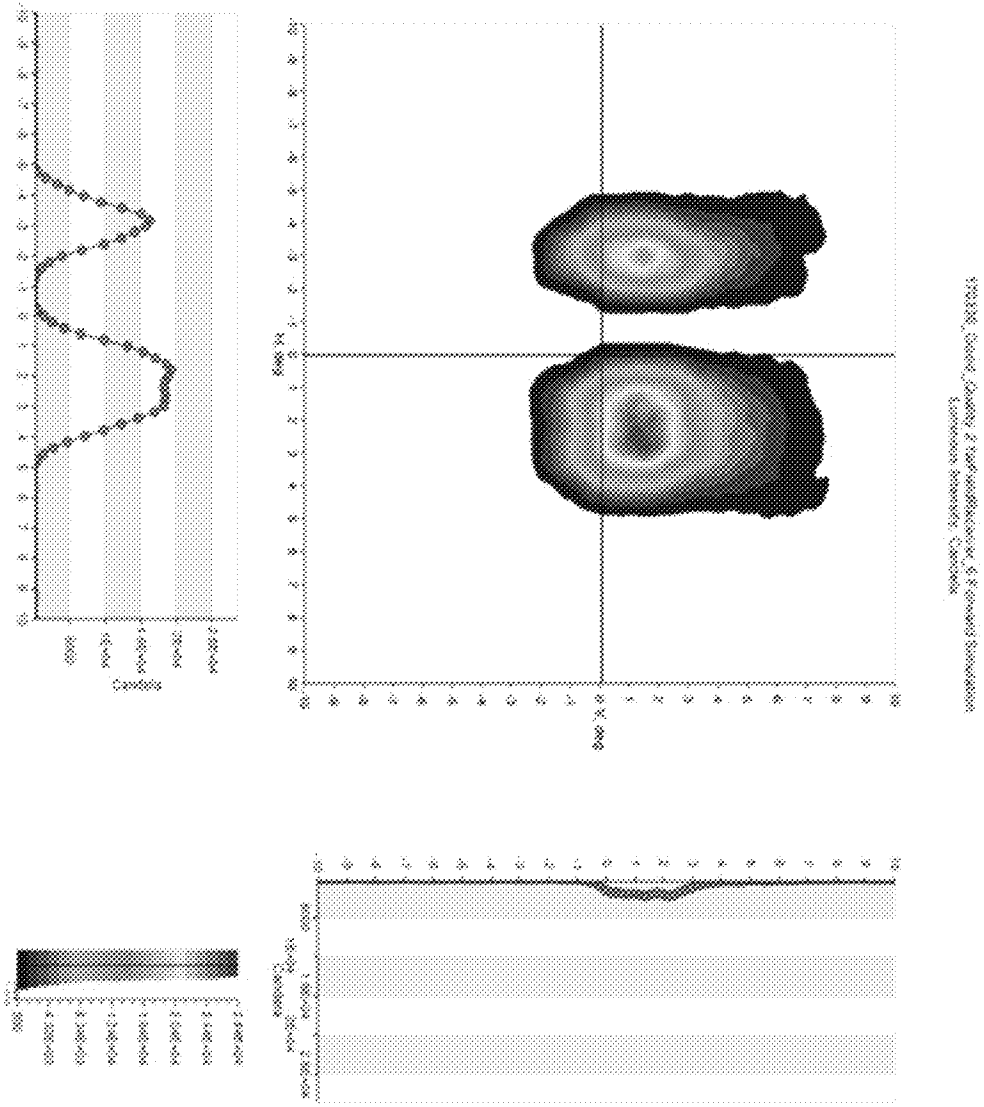
FIG. 6 illustrates that the light source in accordance with the embodiment of the present invention implements a matrix function.

FIG. 1 is a schematic perspective view illustrating main components of a headlamp apparatus in accordance with an embodiment of the present invention, FIG. 2 is a front view illustrating the headlamp apparatus in accordance with the embodiment of the present invention, FIG. 3 is a perspective view illustrating a reflector in accordance with the embodiment of the present invention, FIG. 4 is a perspective view illustrating a lens in accordance with the embodiment of the present invention, FIG. 5 illustrates an operation state of a light source in accordance with the embodiment of the present invention, and FIG. 6 illustrates that the light source in accordance with the embodiment of the present invention implements a matrix function.

As illustrated in FIGS. 1 to 4, the headlamp apparatus 1 in accordance with the embodiment of the present invention may include a light source 10, a reflector 20 and a lens 30. The light source 10 may emit light, the reflector 20 may have a reflecting surface 22 with different curvatures in first and second directions D1 and D2 crossing each other, and reflect the light emitted from the light source 10, and the lens 30 may receive the light through the reflector 20, and change the magnification of the light so as to guide the light to the front.

The light source 10 may include LED light sources 14 using LEDs and a substrate member 12 having the LED light sources 14 mounted thereon, and generate light. The light source used in the light source 10 may include various types of light sources as well as the LEDs, as long as the light sources can generate light. The light source 10 in accordance with the present embodiment may include the plurality of LED light sources 14 arranged in a matrix shape on the substrate member 12, and a turn-on of each of the LED light sources 14 may be separately controlled.

For example, as illustrated in FIG. 5, the light source 10 may supply a constant amount of light at the left and right sides, when all of the LED light sources 14 are operated. Furthermore, as illustrated in FIG. 6, the light source 10 may implement a matrix function by controlling the LED light sources 14, when a vehicle comes in the opposite direction. For example, the light source 10 may lower the illumination of the LED light sources 14 or disable the LED light sources 14, in order to implement a matrix function. The light source 10 in accordance with the embodiment of the present invention may separately control the brightness and turn-on/off of each of the LED light sources 14.

As illustrated in FIGS. 1 to 4, the reflector 20 may be installed at a position separated from the light source 10, and have the reflecting surface 22 with different curvatures in the first and second directions D1 and D2 crossing each other. The reflector 20 may reflect the light emitted from the light source 10 toward the lens 30.

An optical system in which a curve in the side-to-side direction (based on FIG. 1) is different from a curve in the top-to-bottom direction may be referred to as an anamorphic optical system. The reflector 20 and the lens 30, to which the anamorphic optical system is applied, may change the magnification of emitted light with respect to incident light in a specific cross-sectional direction of the incident light by reducing/enlarging the incident light. The anamorphic technology may be applied to the reflecting surface 22 of the reflector 20 in accordance with the present embodiment.

The reflector 20 in accordance with the present embodiment may include a reflecting surface 22 and a base member 24. The reflecting surface 22 extended in an upward slope direction from the base member 24 installed in the horizontal direction may be formed in a concave shape toward the light source 10.

The reflecting surface 22 in accordance with the present embodiment may form a concavely curved surface toward the light source 10, and a first curvature radius R1 in the first direction D1 may be larger than a second radius curvature R2 in the second direction D2. The first direction D1 may be set to the top-to-bottom direction of the reflecting surface 22, and the second direction D2 may be set to the side-to-side direction of the reflecting surface 22.

For example, the ratio of the first curvature radius R1 to the second radius curvature R2 may be set to 1:10. Therefore, the light transferred to the reflecting surface 22 from the light source 10 may be moved toward the lens 30 while being concentrated toward the center.

Since the reflecting surface 22 is formed in a curved shape without a stepped portion, the reflecting surface 22 can prevent diffused reflection of light generated from a stepped portion, thereby preventing a glare problem and luminance efficiency reduction. The reflecting surface 22 in accordance with the present embodiment may be formed with a stepless anamorphic surface.

The lens 30 can be modified in various shapes, as long as the lens 30 receives light through the reflector 20, changes the magnification of the light so as to guide the light to the front (left based on FIG. 1, and uses a lens to which the anamorphic technique is applied.

The anamorphic lens applied to the lens 30 may have different magnifications in the side-to-side direction and the top-to-bottom direction. For this configuration, a curved surface having different curvatures in the top-to-bottom direction and the side-to-side direction may be applied to the lens 30. The reflecting surface 22 may have a larger size than the lens 30. Since the lens 30 exposed to the outside can be reduced in size and the reflecting surface 22 for collecting light has a larger size than the lens 30, the luminance efficiency can be improved. When the product is installed, interference with other parts can be minimized. Therefore, the external size of the module related to the optical system of the headlamp apparatus 1 can be reduced, which makes it possible to implement a slim image of the headlamp apparatus 1.

The lens 30 in accordance with the present embodiment may include a first lens 32 facing the reflecting surface 22 and a second lens 34 connected to the first lens 32.

The first lens 32 may face the reflector 20, and light incident through the first lens 32 may be transferred to the second lens 34. The first lens 32 in accordance with the present embodiment may form a convexly curved surface or flat surface toward the reflector 20.

The second lens 34 may be integrated with the first lens 32 during a forming process, and installed so as to face the opposite direction of the first lens 32. The second lens 34 connected to the first lens 32 may form a convex lens which has different curvatures in third and fourth directions D3 and D4 crossing each other.

The second lens 34 may be formed in a semi-circle cylindrical shape, and the side surface of the second lens 34 may convexly protrude. The third direction D3 may be set to the top-to-bottom direction of the second lens 34, and the fourth direction D4 may be set to the side-to-side direction of the second lens 34. That is, the third direction D3 which is extended along the surface of the lens protruding outward along the side surface of the second lens 34 may cross the fourth direction D4.

The fourth direction D4 may indicate the direction of a curved surface formed at the outside of the second lens 34 on a virtual cross-section obtained by cutting the second lens 34 in the side-to-side direction.

Since a third curvature radius R3 in the third direction D3 is smaller than a fourth curvature radius R4 in the fourth direction D4, light passing through the second lens 34 may be concentrated toward the center from the side-to-side direction.

For example, the ratio of the third curvature radius R3 to the fourth curvature radius R4 may be set to 10:1. Therefore, the light passing through the second lens 34 may be moved while being concentrated toward the center from the side-to-side direction.

Hereafter, the operation state of the headlamp apparatus 1 in accordance with the embodiment of the present invention will be described in detail with reference to the accompanying drawings.

The light generated from the light source 10 may be reflected from the anamorphic reflecting surface 22, and then moved toward the lens 30. Since the first and second curvature radiuses R1 and R2 of the reflector 20 are different from each other, the light transferred to the reflecting surface 22 from the light source 10 may be moved toward the lens 30 while the light in the top-to-bottom direction is concentrated toward the center.

The light passed through the first lens 32 may be passed through the second lens 34, and irradiated to the front after being concentrated toward the center from the side-to-side direction.

Since the anamorphic technique is applied to the reflector 20 and the lens 30, a stepless curved surface may be used, and a glare problem caused by diffused reflection of light generated from a stepped portion can be prevented. Furthermore, the reflecting surface-type optical system module for implementing a matrix beam can be slimmed, and the luminance efficiency can be improved while the manufacturing cost is reduced.

In accordance with the present embodiment, the headlamp apparatus can implement a matrix beam though the lens and the reflecting surface 22 with different curvatures, thereby improving the luminance efficiency. Therefore, since the number of LED light sources 14 is reduced, it is possible to reduce the manufacturing cost. Furthermore, the height of the lens 30 can be reduced, and the external size of the product can be reduced. Therefore, it is possible to improve the mounting compatibility of the product.

Although preferred embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. A headlamp apparatus comprising:

a light source configured to emit light;

a reflector comprising a reflecting surface having different curvatures in first and second directions crossing each other, and configured to reflect a light emitted from the light source; and a lens configured to receive the light through the reflector, and change a magnification of the light so as to guide the light through a front of the headlamp apparatus;

wherein the light source comprises a plurality of LED light sources, and each of the LED light sources is separately activated.

2. The headlamp apparatus of claim 1, wherein the plurality of LED light sources is arranged in a matrix shape.

3. The headlamp apparatus of claim 1, wherein the reflecting surface forms a concavely curved surface toward the light source, and a second curvature radius in the second direction is larger than a first curvature radius in the first direction.

4. The headlamp apparatus of claim 3, wherein the first direction is a top-to-bottom direction with respect to the reflecting surface, and the second direction is a side-to-side direction with respect to the reflecting surface.

5. The headlamp apparatus of claim 1, wherein the lens comprises:

a first lens facing the reflector; and a second lens connected to the first lens, and formed in a convex shape so as to have different curvatures in third and fourth directions crossing each other.

6. The headlamp apparatus of claim 5, wherein the second lens is integrated with the first lens through a forming process.

7. The headlamp apparatus of claim 6, wherein the second lens is installed to face a surface of the first lens that is away from the reflector, and configured to be formed in a semi-circle cylindrical shape.

8. The headlamp apparatus of claim 5, wherein the first lens forms a convexly curved surface or flat surface toward the reflector.

9. The headlamp apparatus of claim 8, wherein a fourth curvature radius in the fourth direction is smaller than a third curvature radius in the third direction.

10. The headlamp apparatus of claim 9, wherein the third direction is a top-to-bottom direction with respect to the second lens, and the fourth direction is a side-to-side direction with respect to the second lens.

* * * * *